US009745802B2

(12) United States Patent
Morrison et al.

(10) Patent No.: US 9,745,802 B2
(45) Date of Patent: Aug. 29, 2017

(54) CONNECTION BETWEEN WELLBORE COMPONENTS

(71) Applicant: Weatherford Technology Holdings, LLC, Houston, TX (US)

(72) Inventors: Jeffery Morrison, Missouri City, TX (US); Kevin Wood, Houston, TX (US); Richard Lee Giroux, Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 14/611,941

(22) Filed: Feb. 2, 2015

(65) Prior Publication Data

US 2016/0222738 A1 Aug. 4, 2016

(51) Int. Cl.
*E21B 17/046* (2006.01)

(52) U.S. Cl.
CPC ..... *E21B 17/046* (2013.01)

(58) Field of Classification Search
CPC .... E21B 17/046; E21B 17/043; F16L 37/113; F16L 37/252; F16L 37/248
See application file for complete search history.

(56) References Cited

U.S. PATENT DOCUMENTS 3,098,667 A * 7/1963 Greenwood ..... E21B 17/06 166/237
3,922,009 A 11/1975 Giebeler
4,010,966 A 3/1977 Vanden Bosch
5,950,724 A 9/1999 Giebeler
8,210,268 B2 7/2012 Heidecke et al.
2005/0087985 A1 4/2005 Mosing et al.
2007/0254516 A1 11/2007 Stoetzer
2013/0207382 A1 8/2013 Robichaux

OTHER PUBLICATIONS

PCT International Search Report and Written Opinion dated May 10, 2016, for International Application No. PCT/US2016/015247.

* cited by examiner

*Primary Examiner* — David Andrews
*Assistant Examiner* — Kristyn Hall
(74) *Attorney, Agent, or Firm* — Patterson & Sheridan, LLP

(57) ABSTRACT

A connection between two wellbore components includes a male portion with sets of male formations formed on an outer surface and male knobs disposed around the outer surface. A female portion has mating sets of female formations formed on an inner surface thereof, with each set separated by a female gap and female knobs disposed around the inner surface. Each male gap is wider than each female formation and each female gap is wider than each male formation. The male and female portions can be mated together in a manner whereby the male sets occupy female gaps and the female sets occupy the male gaps and, thereafter, the male portion is rotatable in a counterclockwise direction relative to the female portion to interconnect the male and female formations, thereby preventing axial movement of one portion relative to the other portion.

11 Claims, 13 Drawing Sheets

CONNECTION BETWEEN WELLBORE COMPONENTS

BACKGROUND OF THE INVENTION

Field of the Invention

The present invention relates to connections between wellbore components. More particularly, the invention relates to a connection between rotating components that results in longer life and less wear.

Description of the Related Art

Wellbore components, both operating in a wellbore and at the surface of the wellbore, are typically rotated in order to drill the wellbore or to insert and run tubular strings to be cemented in the bore. In one instance, during a cementing operation, cement is injected into a work string at an upper end and is pumped through a variety of components before being pumped upwards from a lower end of the well in order to seal an annular area between a tubular string and walls of the wellbore. One component in the string is a cementing head that facilitates the cement job by launching darts that separate cement from other fluids being pumped. Presently, cement heads are threaded into a string in a typical manner. Stresses associated with rotation create wear on the connections and can result in the entire component having to be removed for repair or replaced, leading to delays and additional cost.

What is needed is a connection between wellbore components that can better tolerate stresses generated in use.

SUMMARY OF THE INVENTION

The invention includes a connection between two wellbore components. In one embodiment, a male portion has a plurality of sets of male formations formed on an outer surface and a plurality of male knobs disposed around the outer surface, each knob adjacent a set of the male formations; a female portion has a plurality of mating sets of female formations formed on an inner surface thereof with each set separated by a female gap and a plurality of female knobs disposed around the inner surface, each knob adjacent a set of the female formations. Each male gap is wider than each female formation and each female gap is wider than each male formation wherein the male and female portions can be mated together in a manner whereby the male sets occupy female gaps and the female sets occupy the male gaps and, thereafter, the male portion is rotatable in a counterclockwise direction relative to the female portion to interconnect the male and female formations, thereby preventing axial movement of one portion relative to the other portion.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
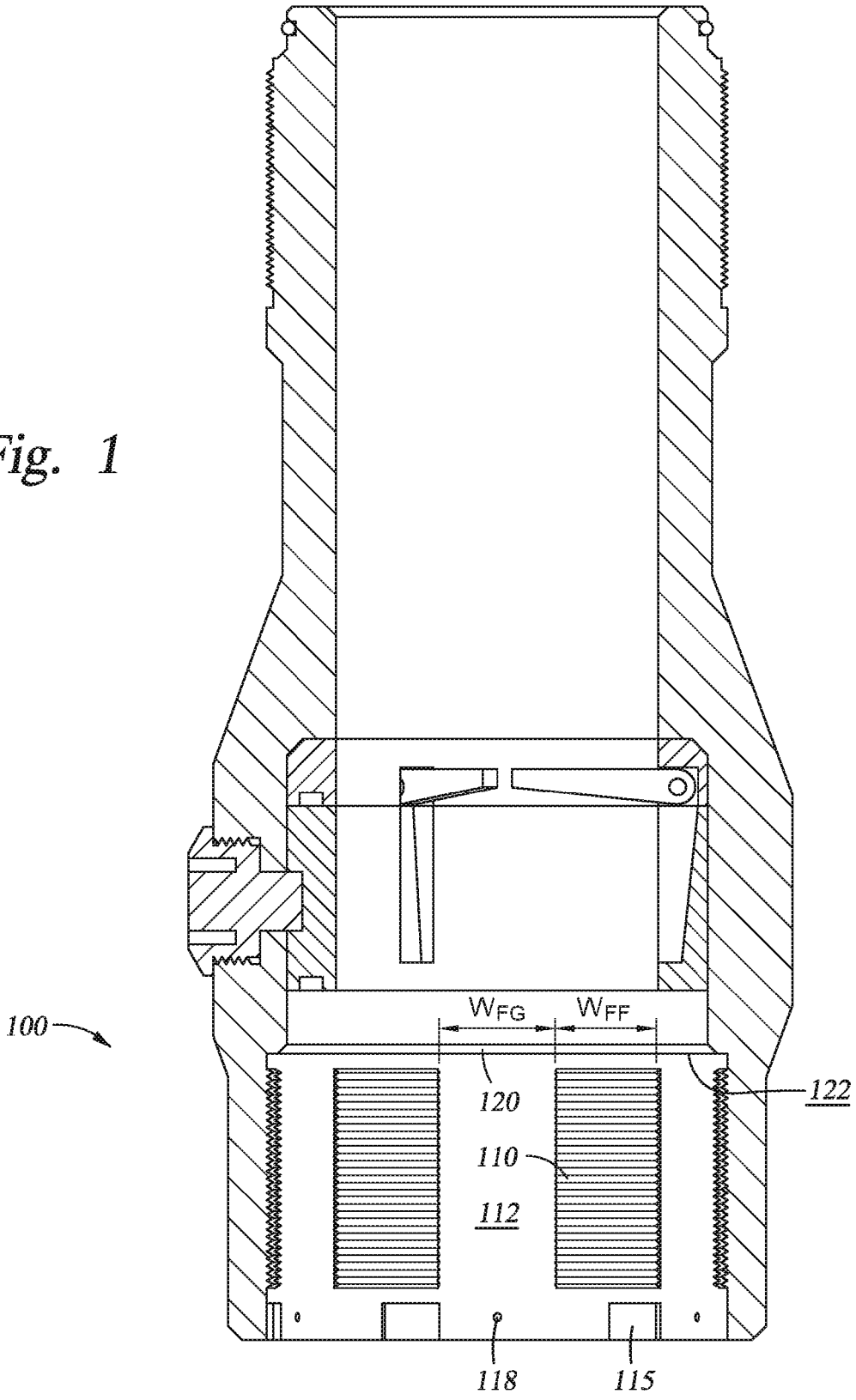
FIG. 1 is a section view of a female portion of a connection.
Figure 2:
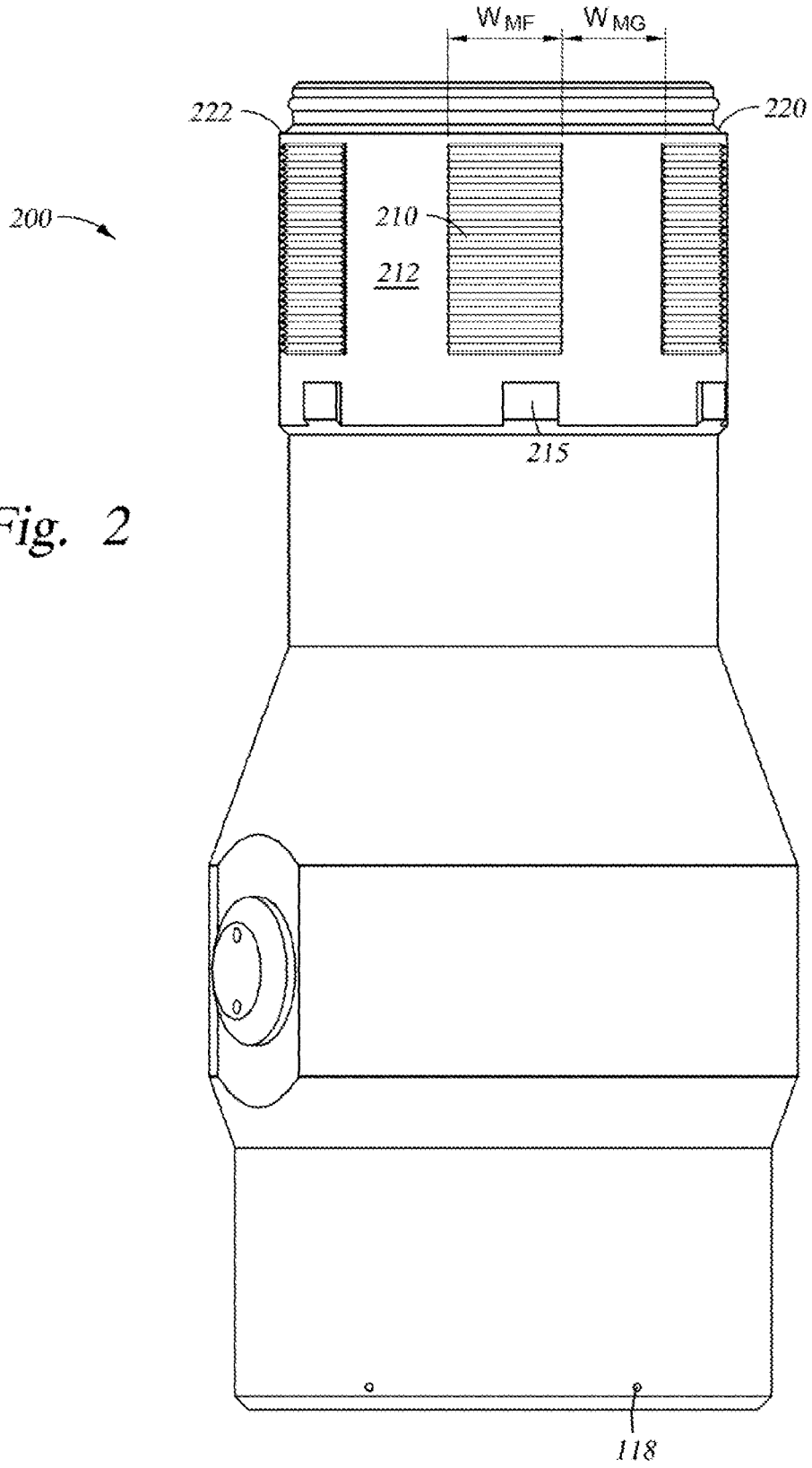
FIG. 2 is a view of a male portion of the connection.

In this disclosure "wellbore components" refers to any components utilized at or in a wellbore and includes connections made and used in a wellbore as well as those made and used at the surface of the well. FIG. 1 is a section view of a female portion 100 of a connection, and FIG. 2 is a view of a male portion 200 of the connection. Regarding FIG. 1, the portion 100 includes a plurality of female formations 110 disposed around an interior of the portion in the area where the connection will be made with the male portion 200. Each set of formations 110 includes any number of grooves (not shown in detail) resembling a thread but lacking any pitch. The grooves are formed one above the other perpendicular to the longitudinal axis of the female portion 100. In the embodiment shown, the plurality of formations 110 are equally spaced around the portion with each having a width Wff and with female gaps 112 between each formation 110. Each female gap has a width Wfg.

At one end of each formation 110 a female anti-rotation knob 115 is formed. As is evident from the Figure, each knob 115 is offset from a centerline of the formation in a manner whereby one side of the knob 115 is aligned with one edge of the formation 110 above it. The formations 110 and the knobs 115 act to form part of the connection with the male portion 200 as will be explained herein. Formed between the knobs and more precisely at a midpoint of each female gap is an aperture 118 that is alignable with apertures formed in another component of the connection to secure the completed connection. In the embodiment shown, the female components of the connection are formed on a cementing head and certain hardware associated with the cement head's use are shown. It will be understood however, that the particular component is not important and the connection portion can be formed on any component or, in some cases, a separate sub can include a female portion 100 at a first end and a male portion 200 at a second end. Two sealing surfaces are formed at an opposite end of the formations 110 from the knobs 115. One surface 120 is a tapered surface and the other sealing surface 122 is a flat surface. Each surface is constructed and arranged to fit mating surfaces of the male portion 200 (FIG. 2).

FIG. 2 shows the male portion 200 that will form a connection with the female portion of FIG. 1. Disposed around an outside surface of the male portion in the area of the connection are a plurality of male formations 210, each of which has a width Wmf and each of which is separated by male gaps 212 having a width Wmg. As with the female portion, the male portion includes a plurality of male anti-rotation knobs 215, each of which is located at an end of each formation 210 and offset in a manner whereby one side of each knob is aligned with an edge of a corresponding formation. The male portion also includes a nose portion with sealing surfaces 220, 222 that mate with surfaces 120, 122 of the female portion in order to facilitate the sealing of the male and female portions when they are mated.

As shown, the component of FIG. 1 includes male threads of the connection at an upper end. In fact, separate sections, or subs can be used with male and female connections permitting the components to be connected in series. While FIG. 1 shows a component with a male connection at an upper end, it will be understood that the connection of the invention can be used in any manner and the component of FIG. 1 could have a conventional threaded attachment means at an upper end.

Figure 3:
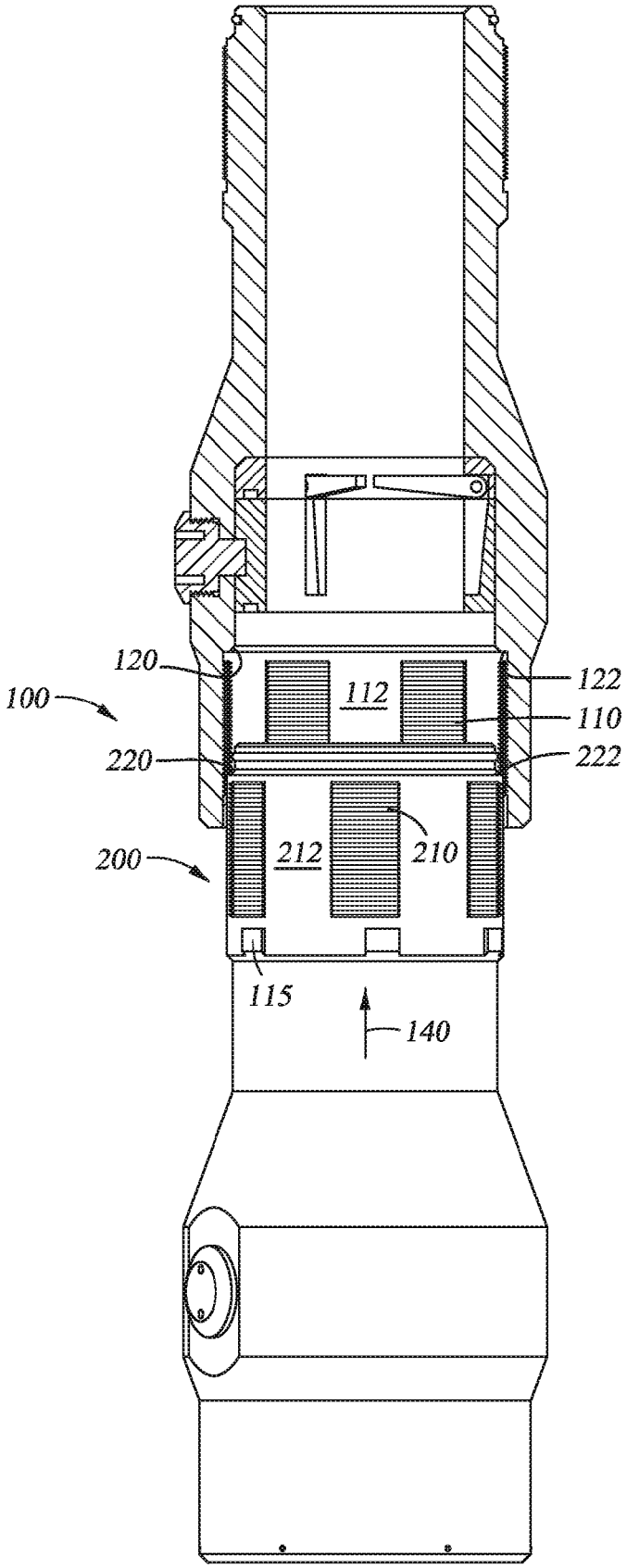
FIG. 3 is a partial section view of the connection with the male portion partially inserted into the female portion.

FIG. 3 is a partial section view of the connection with the male portion 200 partially inserted into the female portion 100. As illustrated, as the connection is made, the male portion is inserted into the female portion in a manner whereby the formations 110, 210 of each portion 100, 200 occupy the gaps 112, 212 of the other portion. To make this possible the female formations 110 are of a smaller width Wff than the width Wmg of the male gaps 212 and the male formations 210 are of a smaller width Wff than the width Wfg of the female gaps 112. Movement of the male portion into the female portion is shown by arrow 140.

Figure 4:
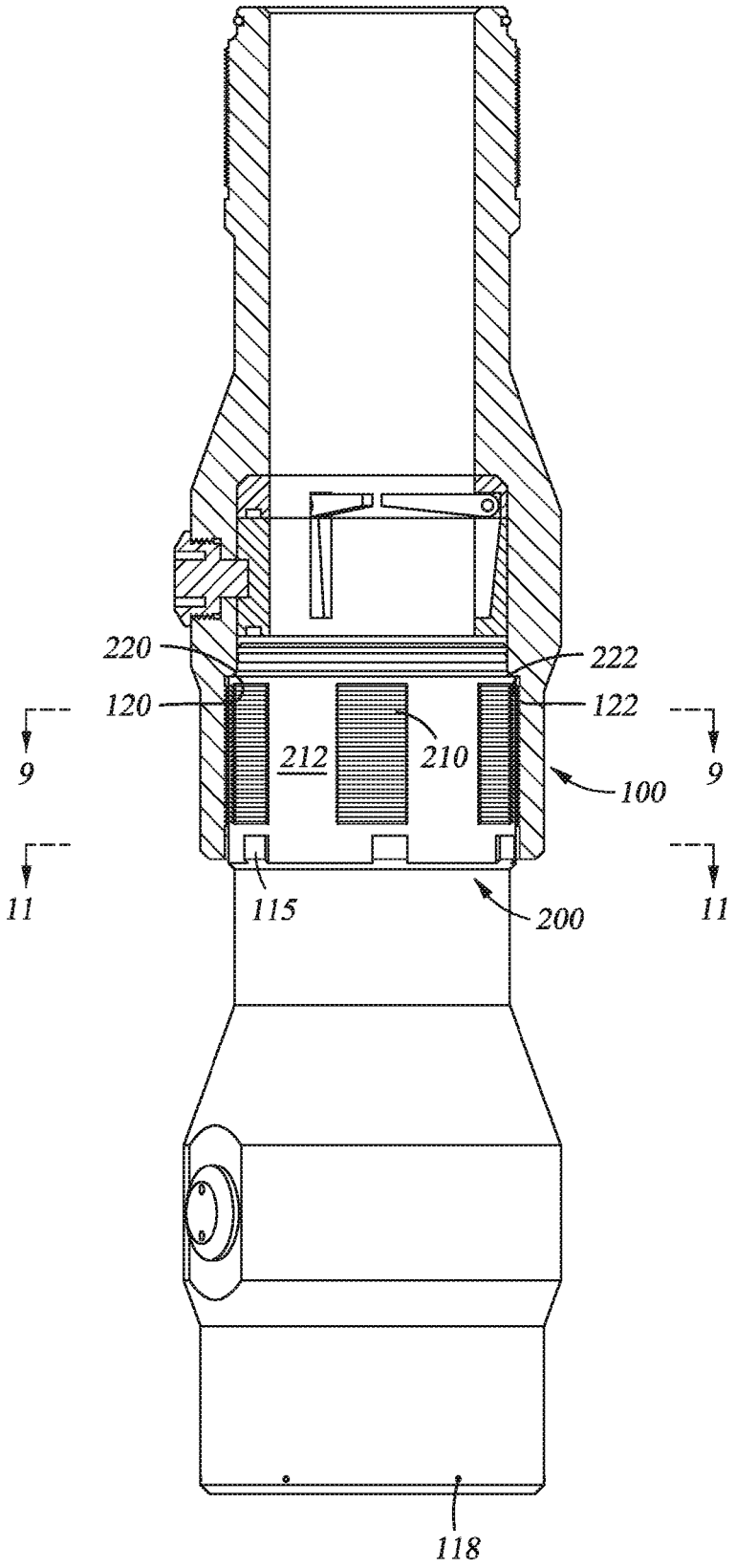
FIG. 4 is a partial section view of the connection with the male portion fully inserted.
Figure 9:
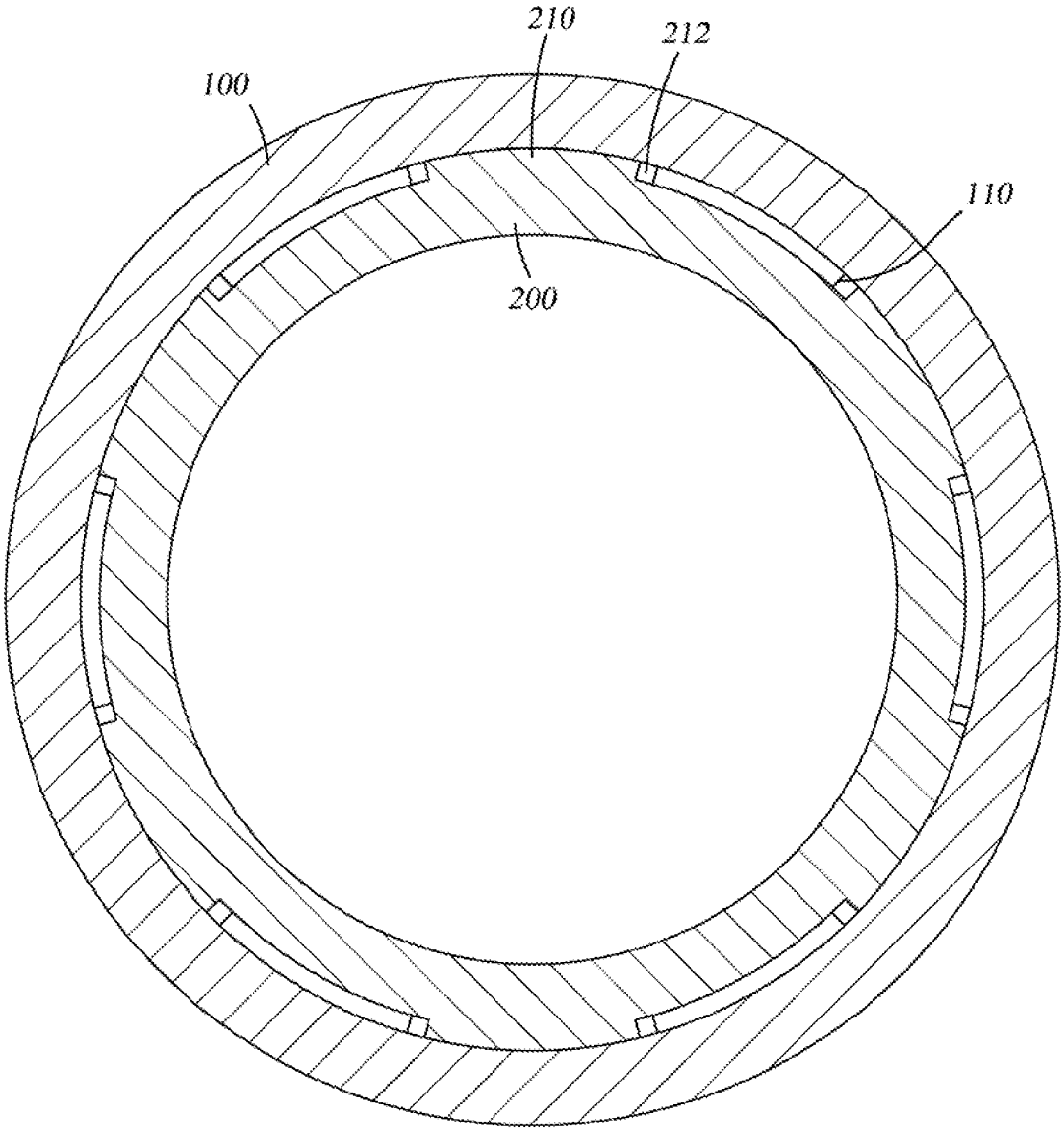
FIG. 9 is a section view taken along lines 9-9 of FIG. 4.
Figure 11:
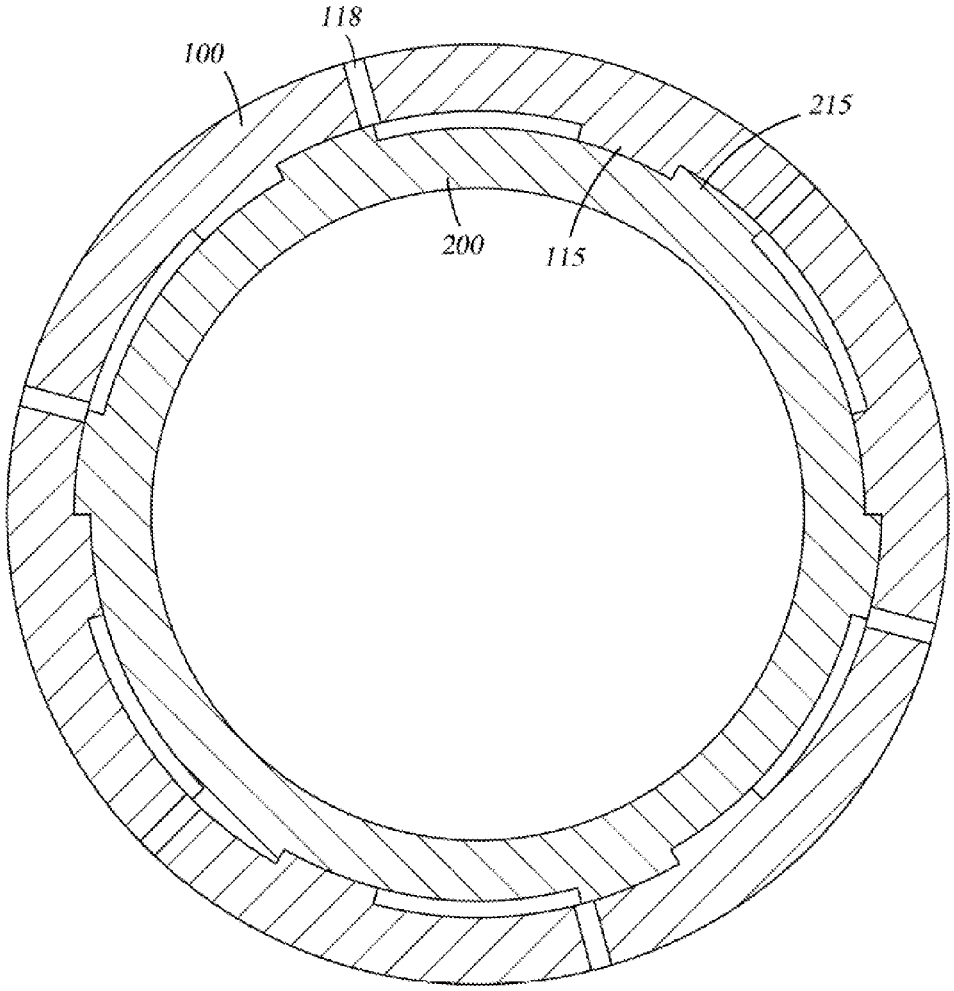
FIG. 11 is a section view taken along line 11-11 of FIG. 4.

FIG. 4 is a partial section view of the connection with the male portion 200 fully inserted. In this view, the formations of the male portion 210 are visible while the corresponding formations of the female portion 110 are hidden. As shown, the sealing surfaces of the male portion 220, 222 have sealed against surfaces 120, 122 of the female portion. FIG. 9 is a section view taken along lines 9-9 of FIG. 4. The purpose of FIG. 9 is to show the formations of each portion in the position of FIG. 4 wherein the male portion 200 has been inserted but not yet rotated within the female portion 100. As illustrated in FIG. 9, the male formations 210 are visible and the female formations 110 are also visible but not in section as the formations 110, 210 are ready to be threaded together and the female formations are necessarily slightly below the plane of the section view. Also visible is the differences in the width between the female formations 110 and the male gaps 212. FIG. 11 is a section view taken along line 11-11 of FIG. 4. The section view more specifically is taken in the area of the male 215 and female 115 knobs and illustrates how the male portion 200, after axial installation can now be rotated to the left in a counterclockwise direction (appears as clockwise in the section view of FIG. 11) until the knobs 115, 215 interact to stop rotation. Also visible are the apertures 118 formed in the female portion.

Figure 5:
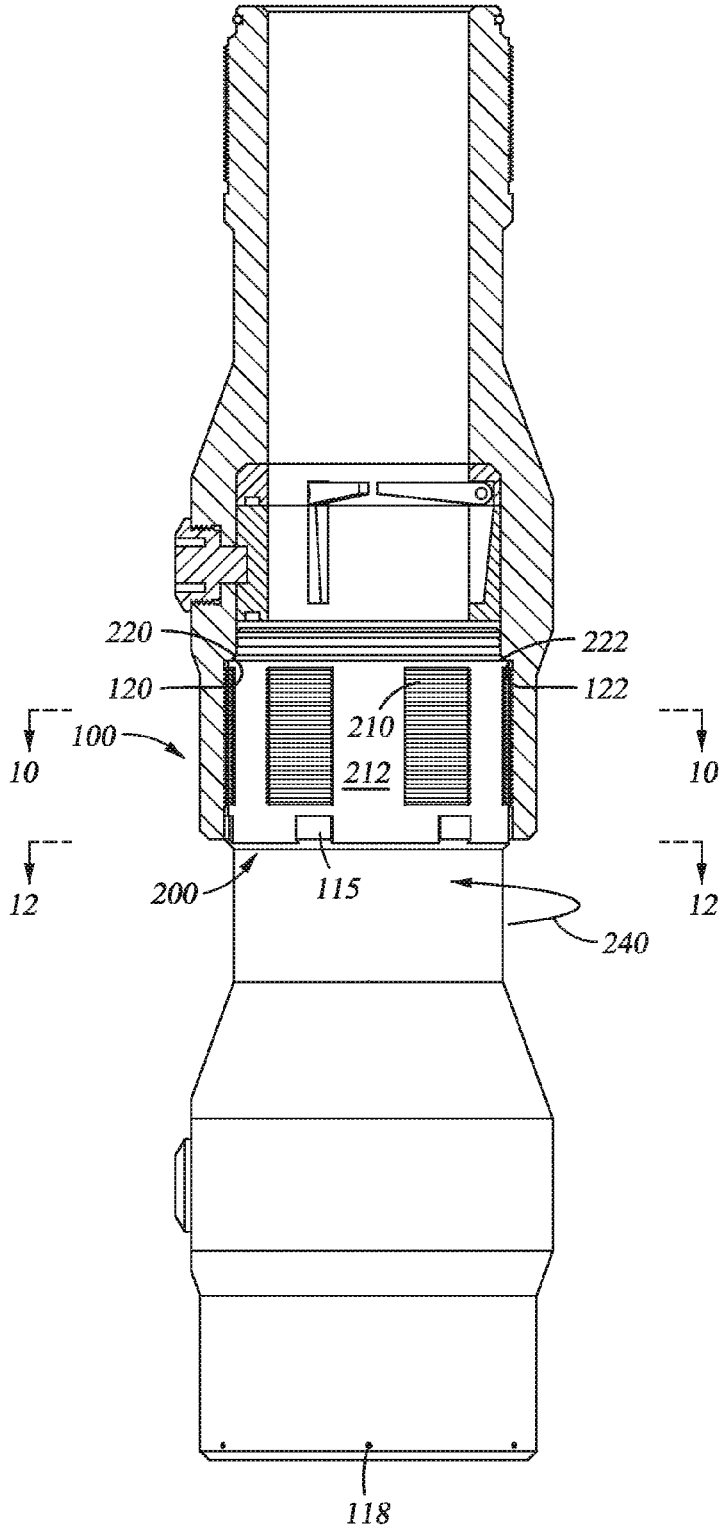
FIG. 5 is a partial section view of the connection after the male portion has been rotated in a counterclockwise direction relative to the female portion.
Figure 10:
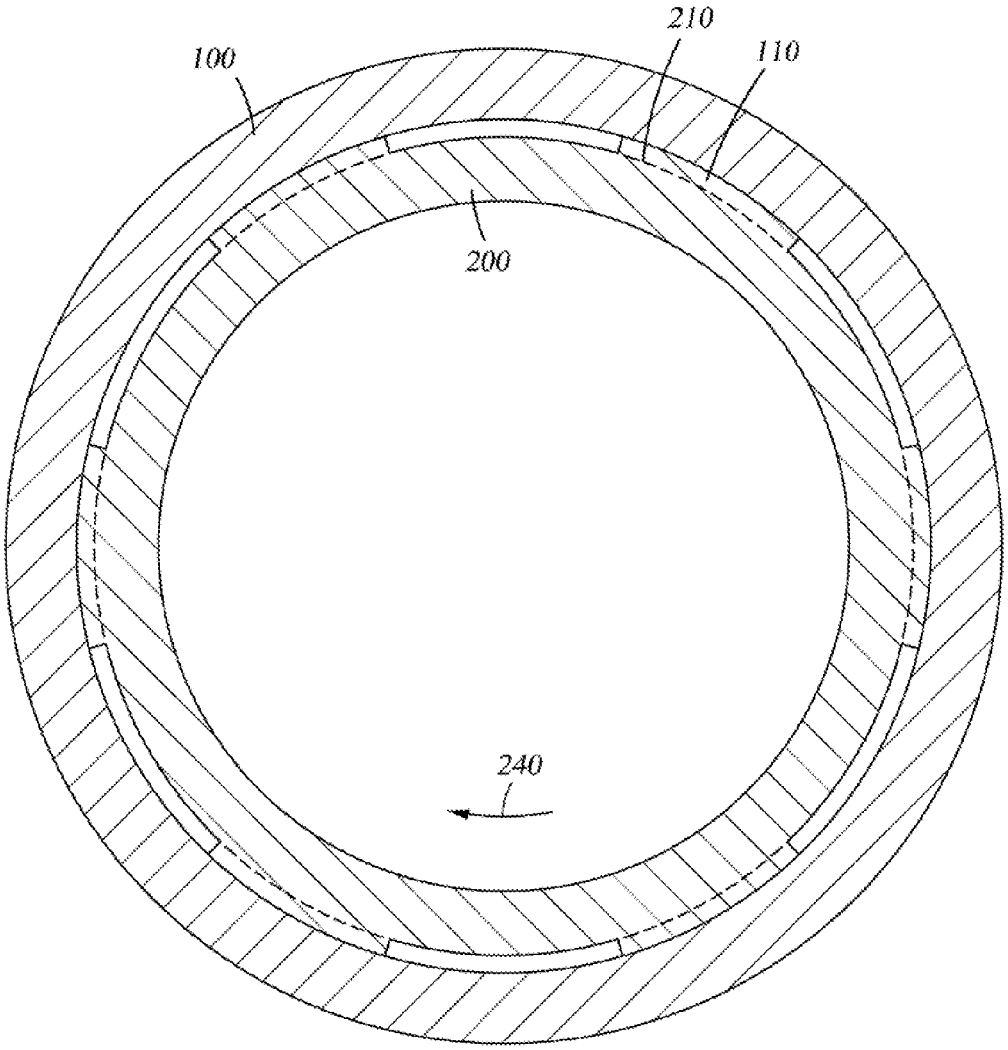
FIG. 10 is a section view taken along lines 10-10 of FIG. 5.
Figure 12:
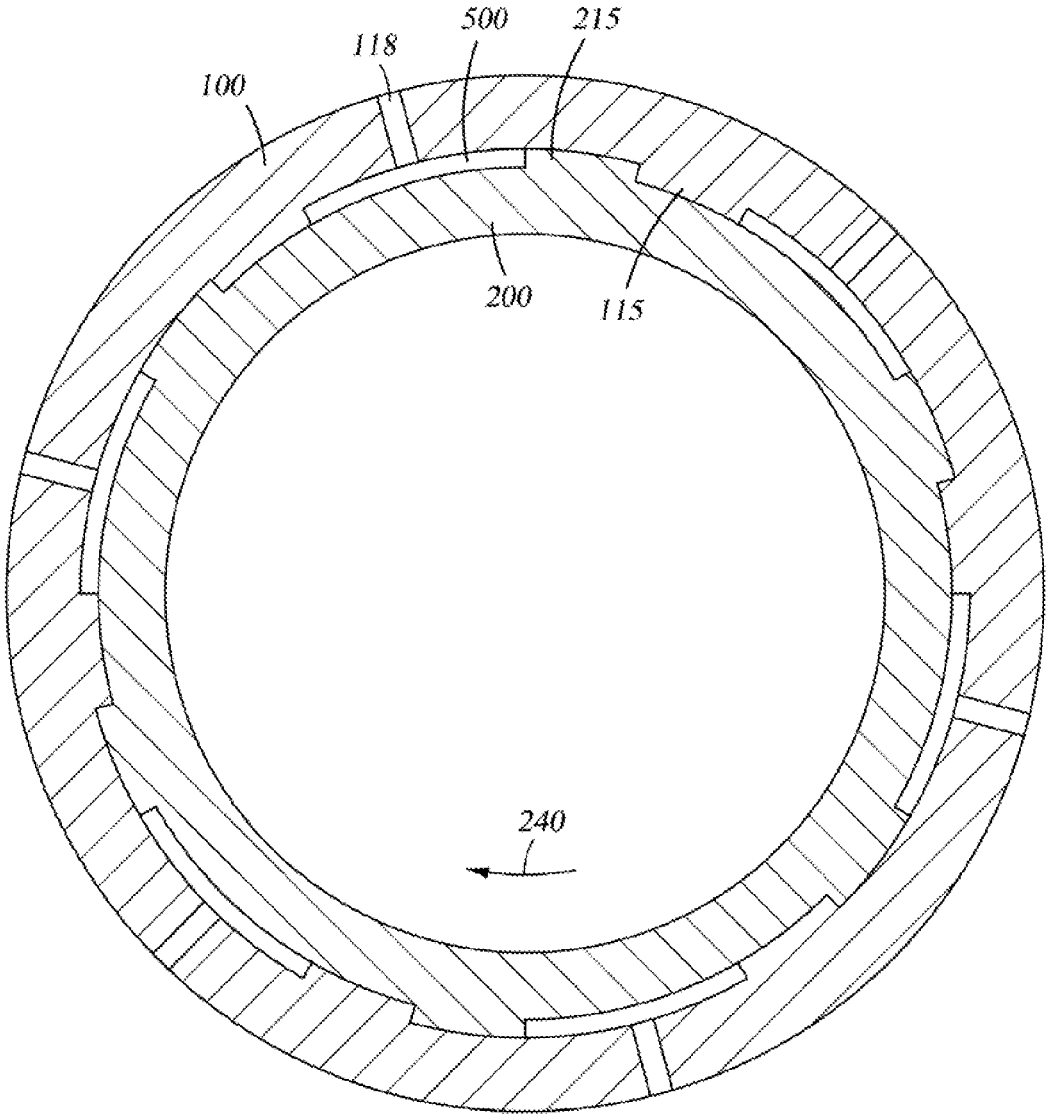
FIG. 12 is a section view taken along a line 12-12 of FIG. 5.

FIG. 5 is a partial section view of the connection after the male portion 200 has been rotated in a counterclockwise direction relative to the female portion 100. The rotation of the male portion has been illustrated by arrow 240. FIG. 10 is a section view of the rotated (rotation shown by arrow 240) portions and like FIG. 9 is taken in the area of the formations. In this case, the formations 110, 210, rather than occupying the gaps between the sets of the other portion, are interconnected or "threaded" together to occupy the same rotational location, leaving the gaps 112, 212 of each portion aligned and running the length of the connection. In the Figure the female formations are shown in section. FIG. 12 is a section view taken along a line 12-12 of FIG. 5. The figure shows the portions after counterclockwise rotation 240 of the male portion. The figure shows the interaction of the male 215 and female 115 knobs as they interfere with each other and prevent additional rotation of the male portion 200 within the female portion 100. The knobs are constructed and arranged to interfere with each other when the formations are completely interconnected and occupying the same rotational location. After rotation, a "knob gap" 500 is formed between adjacent knobs 115, 215.

Figure 6:
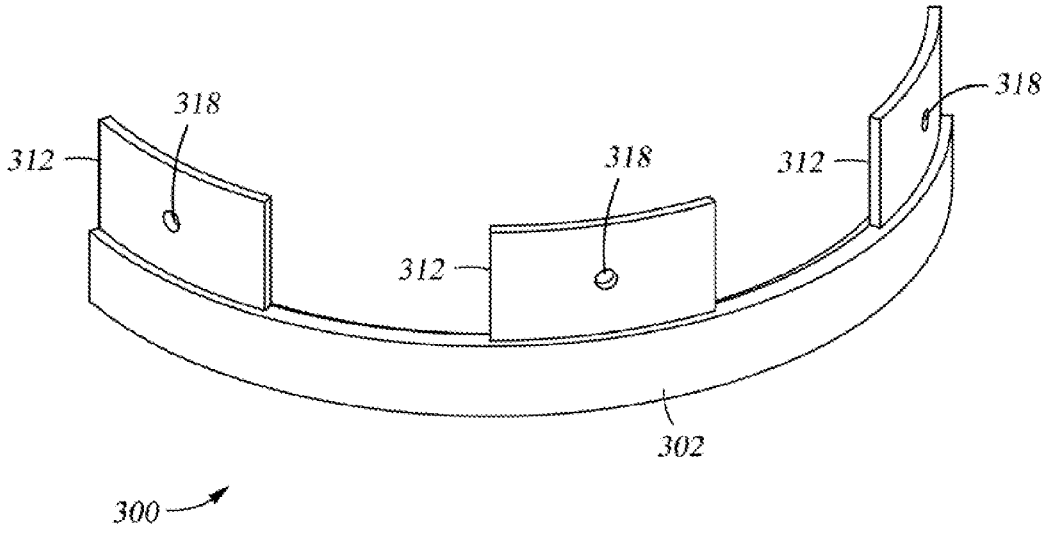
FIG. 6 is a perspective view of a tab holder with tabs.

FIG. 6 is a perspective view of a tab holder 300 with tabs 312. In the example shown, the holder includes a base portion 302 as well as three tabs. The purpose of the tabs 312 is to be inserted into the completed and rotated connection and to fill the knob gaps 500 between male and female knobs 115, 215 in order to prevent the male portion 200 from rotating clockwise, relative to the female portion 100. In the example shown, the base portion 302 of the holder 300 forms a partial circle but the holder/base portion could be formed in a variety of ways so long as the tabs 312 are placed along the base portion in a manner whereby they are spaced to fit the gaps 112, 212 of the connection. In one example, there are 6 gaps formed radially around the madeup connection. Two tab holders 300 are then utilized, each of which includes three tabs 312 so the resulting arrangement provides tabs for all six gaps. In the embodiment shown, each tab includes an aperture 318 formed therein which, when inserted into the connection aligns with the apertures 118 formed in the female portion to permit a fastener or other retaining member to be inserted, thereby preventing the tabs from "backing out" of the connection during use. In one embodiment the tabs are intentionally formed of weaker material than the adjacent knobs thereby causing the tabs to be damaged prior to the knobs in the even of high stress. In one example the tabs are formed of material having 110 yield strength while the knobs are 135 yield strength (ksi). Additionally the tabs can be formed in a manner where they are geometrically weaker than the surrounding knobs. In one instance they are simply formed of less material than the knobs resulting in a weaker structure.

Figure 7:
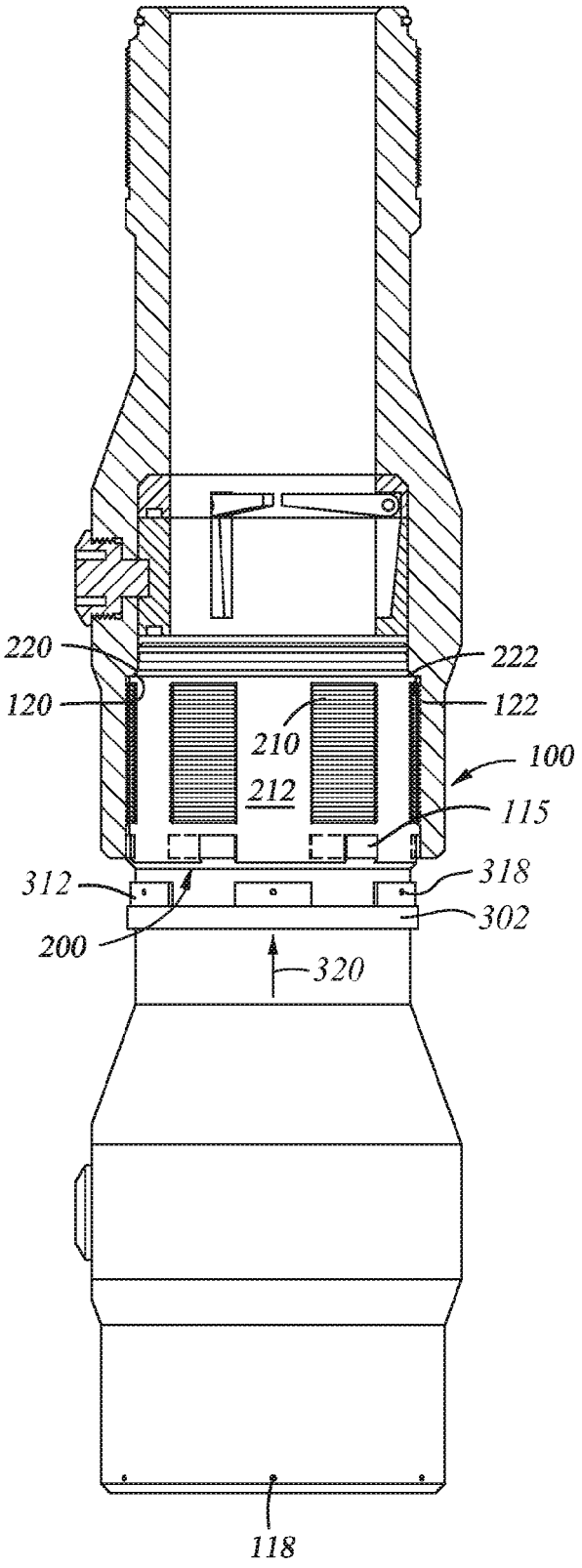
FIG. 7 is a partial section view showing the tab holder and tabs being inserted into the connection.
Figure 8:
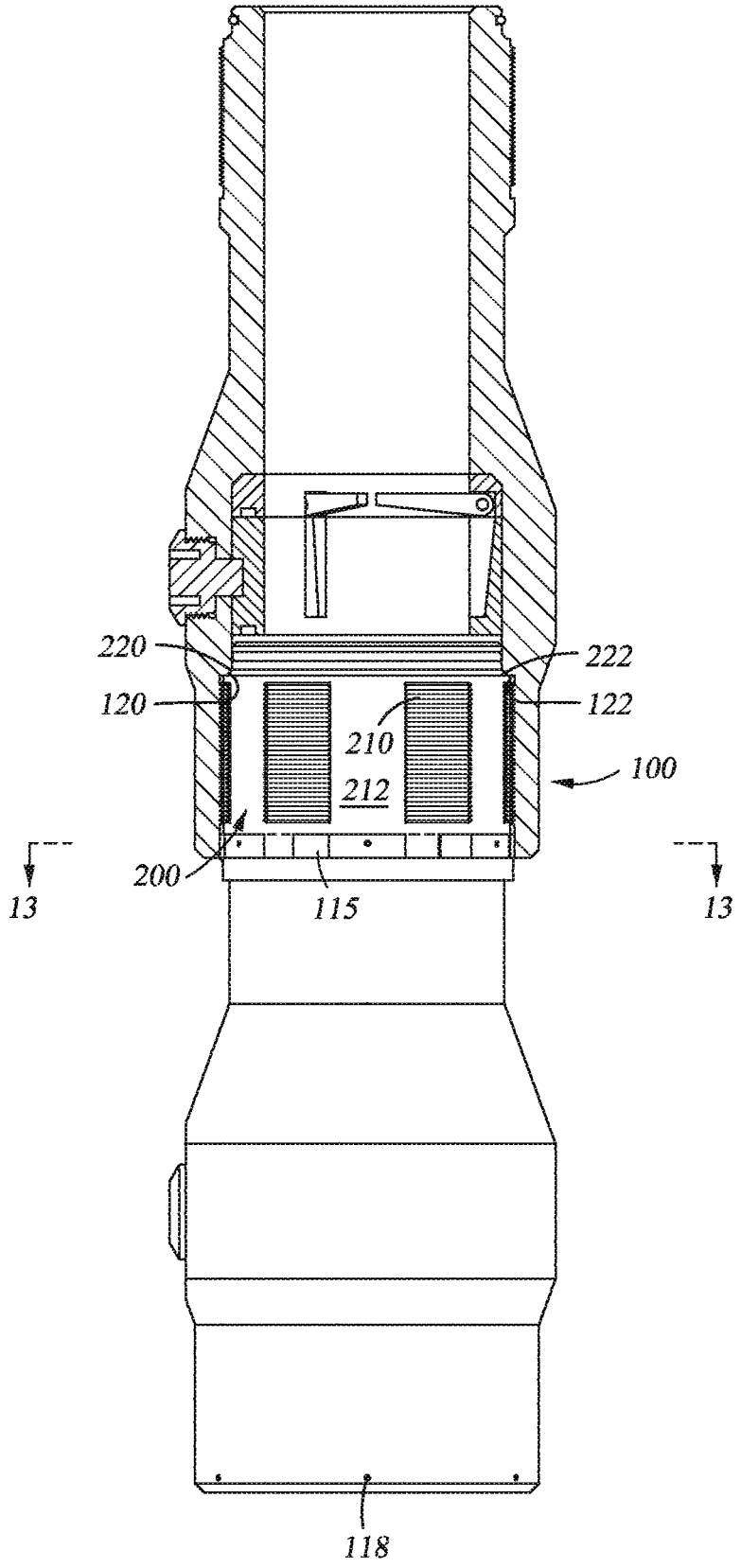
FIG. 8 is a partial section view showing the tabs inserted into the connection.
Figure 13:
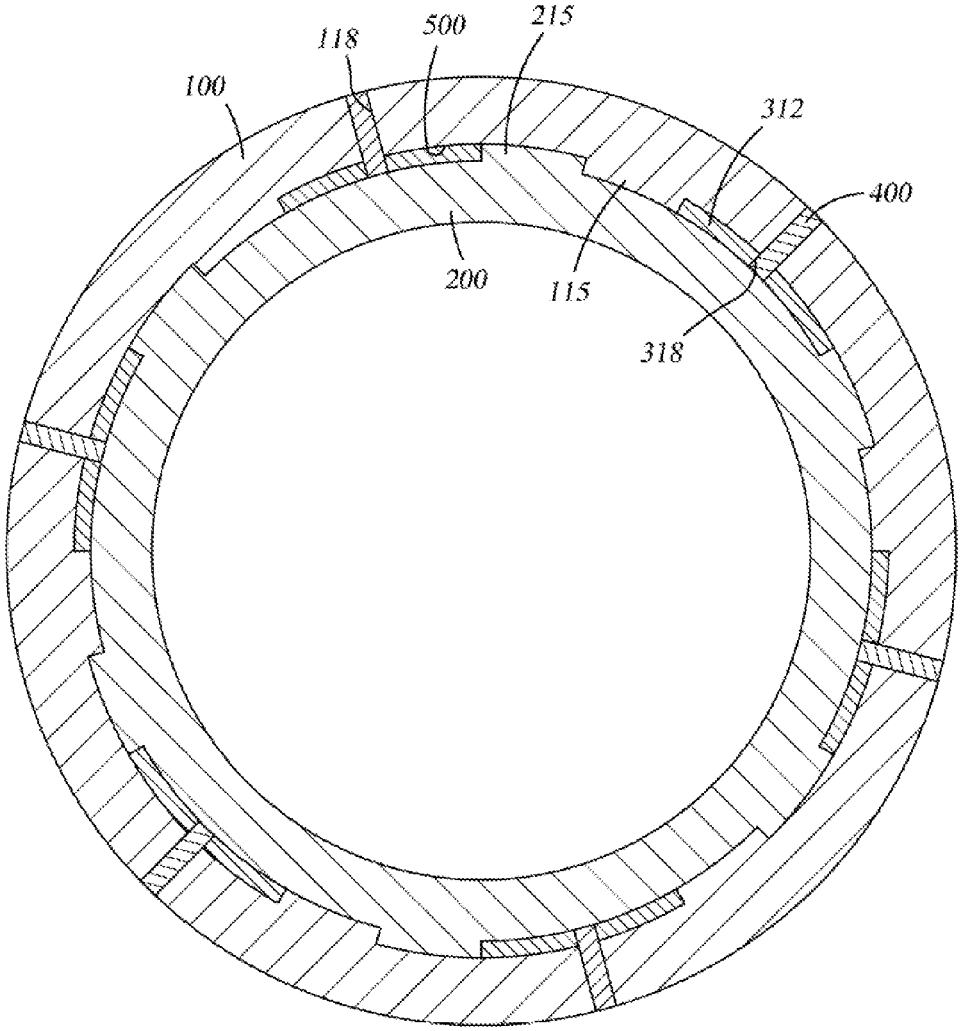
FIG. 13 is a section view taken along a line 13-13 of FIG. 8.

FIG. 7 is a partial section view showing the tab holder 300 and tabs 312 during insertion into the connection (see arrow 320) and FIG. 8 is a partial section view showing the tabs 312 inserted into the connection. In the Figures, the male portion 200 has been inserted into the female portion 100 and rotated counterclockwise to make the connection. The knobs 115, 215 of each portion 100, 200 are shown interfering with each other to prevent further rotation (the knobs 115 of the female portion 100 are shown in dotted lines). FIG. 13 is a section view taken along a line 13-13 of FIG. 8 in the area of the knobs 115, 215 and the tabs 312. The Figure shows the tabs 312 inserted into the knob gap 500 between the knobs. In this position, the tabs prevent clockwise rotation of the male portion relative to the female portion and effectively keep the connection from becoming "unmade". Also shown in the Figure are fasteners 400 that have been inserted through apertures 118 of the female portion 100, as well as the apertures 318 of the tabs 312.

In operation the connection is made up as follows: A male portion is rotated to a position whereby it can be inserted into a female portion (formations are alternating). Thereafter, the male portion is rotated in a counterclockwise direction relative to the female portion with the formations of each acting interconnecting to prevent axial movement between the portions. In one embodiment, further counterclockwise rotation is prevented when knobs of each portion interfere with each other. Thereafter, a tab holder with tabs is inserted into knob gaps formed between the knobs of the male and female connection. The tabs prevent the male portion from rotating clockwise relative to the female portion. In use the two connected components are typically rotated clockwise, thereby the rotational forces tend to be between the tabs and the knobs, rather than between two adjacent knobs of the male and female portions.

The invention claimed is:

1. A connection between two wellbore components, comprising:

a male portion having a plurality of sets of male formations formed on an outer surface thereof each set separated by a male gap;

a plurality of male knobs disposed around the outer surface, each knob adjacent a set of the male formations;

a female portion having a plurality of mating sets of female formations formed on an inner surface thereof, each set separated by a female gap;

a plurality of female knobs disposed around the inner surface, each knob adjacent a set of the female formations;

wherein each male gap is wider than each female formation and each female gap is wider than each male formation and wherein the male and female portions are constructed and arranged to be mated together in a manner whereby the male sets occupy female gaps and the female sets occupy the male gaps and, thereafter, the male portion is rotatable in a counterclockwise direction relative to the female portion to interconnect the male and female formations, thereby preventing axial movement of one portion relative to the other portion;

wherein further clockwise rotation is prevented by contact between at least one male knob and an adjacent female knob;

wherein after rotation, a knob gap is formed between the at least one male knob and a second adjacent female knob; and a tab being constructed and arranged to be inserted into the knob gap to prevent clockwise rotational movement of the female portion relative to the male portion, the tab being constructed of a material having a first yield strength and the plurality of male and female knobs being constructed of a material having a second yield strength, the first yield strength being less than the second yield strength.

2. The connection of claim 1, wherein the knob gap has a width substantially equal to the male and female gaps.

3. The connection of claim 1, wherein the at least one tab is located on a tab holder, the tab holder constructed and arranged to hold and separate a plurality of tabs substantially similar to the at least one tab, thereby facilitating their insertion into mating knob gaps formed in the connection.

4. The connection of claim 3, wherein the tabs, when inserted are retained in the knob gaps, each tab being retained on a first side by a female knob and on a second side by a male knob.

5. The connection of claim 1, wherein the first yield strength is 110 ksi and the second yield strength is 135 ksi.

6. The connection of claim 1, wherein the female portion is a cementing head.

7. A wellbore component having a tubular body, comprising:

a male portion having a plurality of sets of male formations formed on an outer surface thereof, each set separated by a male gap;

a plurality of male knobs disposed around the outer surface, each knob adjacent a set of the male formations;

a female portion having a plurality of mating sets of female formations formed on an inner surface thereof, each set separated by a female gap;

a plurality of female knobs disposed around the inner surface, each knob adjacent a set of the female formations;

wherein each male gap is wider than each female formation and each female gap is wider than each male formation, wherein the male and female portions are constructed and arranged such that an identical male portion of a separate wellbore component can mate with the female portion and an identical female portion of a separate wellbore component can mate with the male portion, wherein the male and female portions are located at opposite ends of the same tubular body.

8. The connection of claim 1, wherein the female portion is located on a first tubular body and the male portion is located on a second tubular body for connection to the first body.

9. A method of making a connection between two tubular members, comprising:

providing a male portion having a plurality of sets of male formations formed on an outer surface thereof each set separated by a male gap and having a plurality of male knobs disposed around the outer surface, each knob adjacent a set of the male formations;

providing a female portion having a plurality of mating sets of female formations formed on an inner surface thereof, each set separated by a female gap and having a plurality of female knobs disposed around the inner surface, each knob adjacent a set of the female formations;

wherein each male gap is wider than each female formation and each female gap is wider than each male formation;

mating the portions together in a manner whereby the male sets occupy female gaps and the female sets occupy the male gaps;

rotating the male portion in a counterclockwise direction relative to the female portion to interconnect the male and female formations, thereby preventing axial movement of one portion relative to the other portion and thereby forming a plurality of knob gaps between each male and an adjacent female knob, the knob gaps substantially equal to the male and female gaps; and inserting at least one tab into at least one of the plurality of knob gaps, wherein the at least one tab is constructed of a material having a first yield strength and the plurality of male and female knobs are constructed of a material having a second yield strength, the first yield strength being less than the second yield strength, whereby each tab is retained on one side by a male knob and on an opposite side by a female knob and the male portion is prevented from clockwise rotation relative to the female portion.

10. The method of claim 9, wherein there are a plurality of tabs mounted and spaced along a tab holder in a manner to facilitate the insertion of each tab in a corresponding knob gap.

11. The method of claim 10, further including rotating one of the portions in a manner whereby the rotational forces take place between both sides of the tabs and one side of each knob adjacent each tab.

* * * * *